US007730897B2

(12) United States Patent
Han et al.

(10) Patent No.: US 7,730,897 B2
(45) **Date of Patent: *Jun. 8, 2010**

(54) DISHWASHER

(75) Inventors: Dae Yeong Han, Seoul (KR); Sang Heon Yoon, Seoul (KR); Nung Seo Park, Incheon (KR); Hyeok Deok Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1178 days.

This patent is subject to a terminal disclaimer.

(21) Appl. No.: 11/070,291

(22) Filed: Mar. 3, 2005

(65) Prior Publication Data

US 2006/0060225 A1 Mar. 23, 2006

(30) Foreign Application Priority Data

Sep. 22, 2004 (KR) ..... 10-2004-0075850

(51) Int. Cl.
*A47L 15/42* (2006.01)

(52) U.S. Cl. ..... 134/104.2; 134/56 D

(58) Field of Classification Search ..... 134/104.2
See application file for complete search history.

(56) References Cited

U.S. PATENT DOCUMENTS

| | | | | |
|---|---|---|---|---|
| 4,150,680 | A | 4/1979 | Johnson et al. | |
| 4,243,431 | A | 1/1981 | Dingler et al. | |
| 4,392,891 | A | 7/1983 | Meyers | |
| 4,448,359 | A | 5/1984 | Meyers | |
| 5,377,707 | A | 1/1995 | Young, Jr. | |
| 5,433,232 | A | 7/1995 | Young, Jr. | |
| 5,450,868 | A | 9/1995 | Young, Jr. | |
| 5,601,660 | A | 2/1997 | Jeon et al. | |
| 5,609,172 | A * | 3/1997 | Chang et al. | 134/57 D |
| 5,779,812 | A | 7/1998 | Thies et al. | |
| 5,909,743 | A | 6/1999 | Thies et al. | |
| 6,182,674 | B1 | 2/2001 | Jozwiak et al. | |
| 6,418,943 | B1 | 7/2002 | Miller | |
| RE37,831 | E | 9/2002 | Thies | |
| 7,409,962 | B2 | 8/2008 | Welch | |
| 2003/0205246 | A1 | 11/2003 | Christman et al. | |
| 2004/0103926 | A1 | 6/2004 | Ha | |
| 2005/0263174 | A1 * | 12/2005 | Yoon et al. | 134/104.1 |

FOREIGN PATENT DOCUMENTS

| | | | |
|---|---|---|---|
| DE | 2951837 | | 7/1980 |
| DE | 2951837 | A1 | 7/1980 |
| DE | 4418523 | A1 | 11/1995 |
| GB | 901 476 | | 7/1962 |
| GB | 2038171 | | 7/1980 |
| GB | 2308171 | * | 7/1980 |
| GB | 2 204 482 | | 11/1988 |

(Continued)

*Primary Examiner*—Michael Barr
*Assistant Examiner*—Jason P Riggleman
(74) *Attorney, Agent, or Firm*—McKenna Long & Aldridge LLP

(57) ABSTRACT

A dishwasher includes a sump for receiving washing water, a washing pump for pumping the washing water from the sump, a drain chamber for receiving the pumped washing water, and a filtering unit disposed above the drain chamber. The filtering unit includes a contaminated water for receiving and filtering the washing water that has passed through the drain chamber.

11 Claims, 13 Drawing Sheets

FOREIGN PATENT DOCUMENTS

| | | |
|---|---|---|
| KR | 1998-057987 | 10/1998 |
| KR | 20-2000-0003391 | 2/2000 |
| KR | 2001-0077128 | 8/2001 |
| KR | 10-0339370 | 6/2002 |
| SU | 1738259 A1 | 6/1992 |

* cited by examiner

DISHWASHER

This application claims the benefit of Korean Application No. P2004-75850 filed on Sep. 22, 2004, which is hereby incorporated by reference.

BACKGROUND OF THE INVENTION

1. Field of the Invention

The present invention relates to a dishwasher, and more particularly, to a dishwasher that can reduce washing water consumption and power consumption.

2. Discussion of the Related Art

A dishwasher is a machine for washing dishes by spraying washing water at high pressure and drying them.

The dishwasher includes a rack, a spray arm and a driving unit within a case. The rack accommodates dishes and the spray arm sprays washing water. The spray arm is disposed at an upper or lower side of the rack.

The driving unit includes a sump and a pump. The sump collects the washing water. The washing water pumped by the pump flows through a washing water pipe and is sprayed through the spray arm. The dishes are washed by the sprayed washing water.

The driving unit for pumping the washing water by using the pump includes various filters and pipes to properly supply the washing water and recollect the washing water sprayed onto the dishes.

Meanwhile, if the washing water sprayed onto the rack is directly drained out, it is a waste of the washing water. Accordingly, there is a demand for a dishwasher having a driving unit that can effectively reuse the washing water.

SUMMARY OF THE INVENTION

Accordingly, the present invention is directed to a dishwasher that substantially obviates one or more problems due to limitations and disadvantages of the related art.

An object of the present invention is to provide a dishwasher that is capable of reducing consumption of washing water.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dishwasher includes a sump for receiving washing water, a washing pump for pumping the washing water from the sump, a drain chamber for receiving the pumped washing water, and a filtering unit disposed above the drain chamber for filtering the washing water introduced to a contaminated water chamber of the filtering unit after the washing water has passed through the drain chamber.

The drain chamber is provided at an entrance side of a drain pump. The drain pump is connected to one side of the sump. The filtering unit includes a cover which covers an upper portion of the contaminated water chamber, the cover including a filter for filtering washing water that overflows from the contaminated water chamber. The cover includes return holes formed at a periphery to communicate with the sump.

The dishwasher further includes at least one main passage for guiding the pumped washing water to a spray arm, and an upper housing including a sampling passage for guiding the pumped washing water not provided to the main passage to the drain chamber.

The dishwasher further includes a contamination sensor disposed at the sampling passage to measure a level of contamination of the washing water. A connecting pipe is connected to the contaminated water chamber and the drain chamber, and an extending end from the sampling passage is inserted into the connecting pipe. The dishwasher further includes a connecting passage provided between the connecting pipe and the extending end of the sampling passage for communicating with the contaminated water chamber and the drain chamber. The dishwasher further includes a passage control unit for selecting to open or close at least one main passage, the passage control unit is located at an intersection of the main passages and the sampling passage.

The filtering unit includes a lower housing including an impeller loading unit and the contaminated water chamber is disposed above the sump, an upper housing including a main passage and a sampling passage formed to guide the pumped washing water is disposed above the lower housing, and a cover for entirely covering an upper portion of the sump, the cover including a filter that covers an upper portion of the contaminated water chamber.

The contaminated water chamber and the drain chamber are connected by a connecting pipe. One end of the sampling passage is positioned inside the connecting pipe. The dishwasher further includes a connecting passage formed between an inner periphery of the connecting pipe and an outer periphery of one end of the sampling passage. The sampling passage and the drain chamber are connected by the connecting passage. The sampling passage is provided to connect an outlet of the impeller loading unit and the drain chamber.

The drain chamber includes a drain hole is provided to the drain chamber for communicating with the sump, and a check valve is provided to the drain hole for opening the drain hole during a draining cycle.

According to another aspect of the present invention, a dishwasher includes a sump for collecting washing water, a washing pump for pumping the washing water, a sampling passage for guiding for the pumped washing water to a drain chamber, a drain chamber for receiving the pumped washing water, a contaminated water chamber disposed above the drain chamber for receiving the washing water after the washing water has passed through the drain chamber, and a filtering unit covering an upper portion of the contaminated water chamber and filtering the washing water that overflows from the contaminated water chamber.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
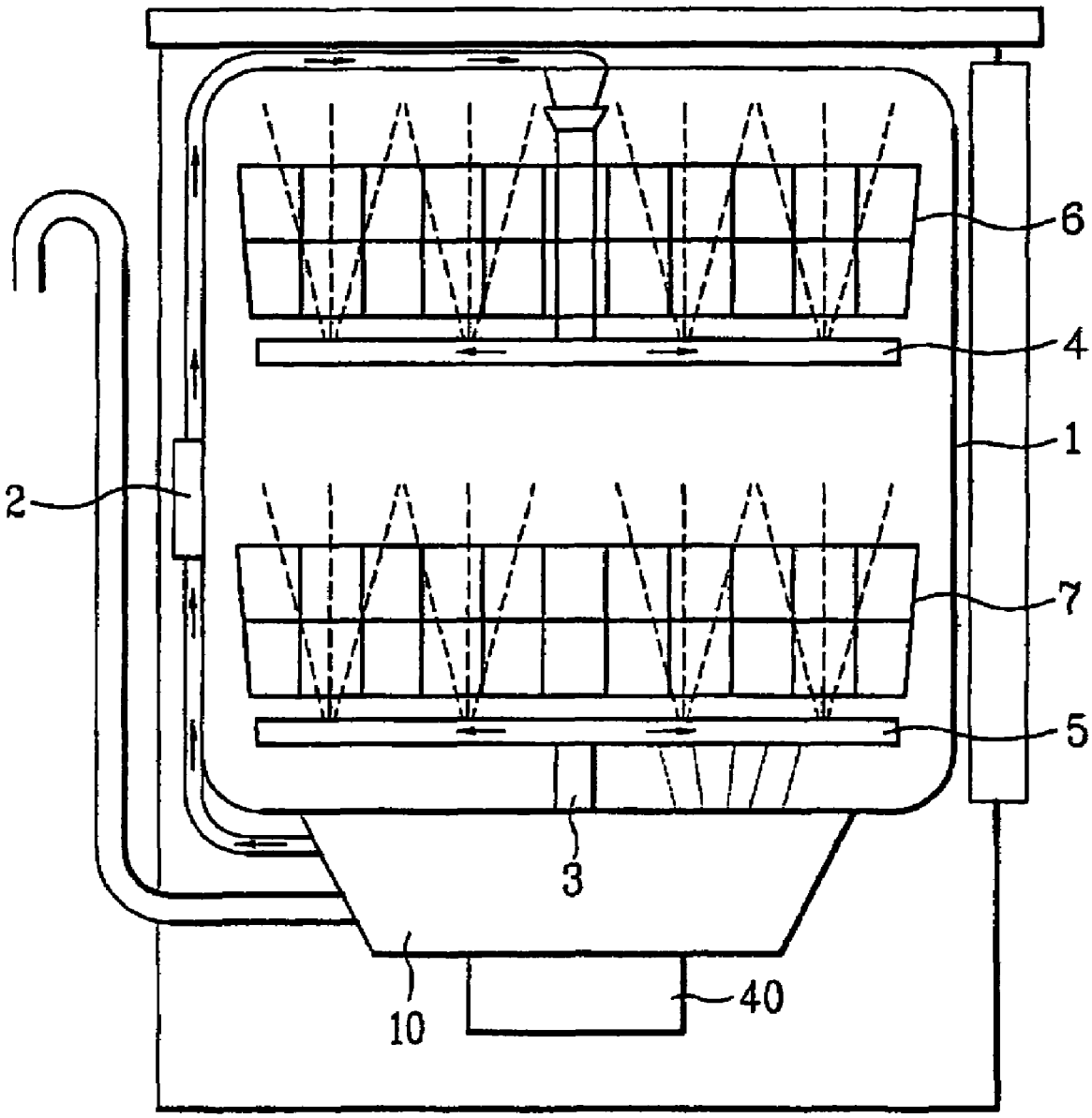
FIG. 1 is a schematic view of a dishwasher according to the present invention.

FIG. 1 is a schematic view of a dishwasher according to the present invention.

Referring to FIG. 1, a dishwasher includes a tub 1, upper and lower spray arms 4 and 5, upper and lower racks 6 and 7, and a driving unit 10.

The tub 1 has a washing space where dishes are washed, and the upper and lower spray arms 4 and 5 are respectively disposed at inner upper and lower portions of the tub 1. The upper rack 6 is disposed above the spray arm 4 and the lower rack 7 is disposed above the lower spray arm 5. The racks 6 and 7 accommodate the dishes.

The driving unit 10 includes a sump and a pump. The sump collects washing water. One end of the sump is connected to the pump 40 disposed at a lower portion of the driving unit. The washing water collected in the sump is pumped by the pump 40 and then flows through upper and lower guide pipes 2 and 3 to the spray arms 4 and 5.

It is preferable that the upper and lower spray arms 4 and 6 are rotatably installed in an upper portion of the driving unit 10. The spray arms 4 and 6 have spray holes through which the washing water is sprayed to the corresponding racks 6 and 7. The dishes accommodated in the racks are washed by the washing water sprayed through the spray holes.

Furthermore, a filter is provided at an upper surface of the driving unit so as to filter waste products falling down together with the washing water. That is, the waste products is collected on an upper surface of the filter and the washing water passes through the filter and is dropped into the sump. Further, in order to wash the waste products collected on the upper surface of the filter, additional spray holes facing the upper surface of the filter may be formed below the lower spray arm 6.

Figure 2:
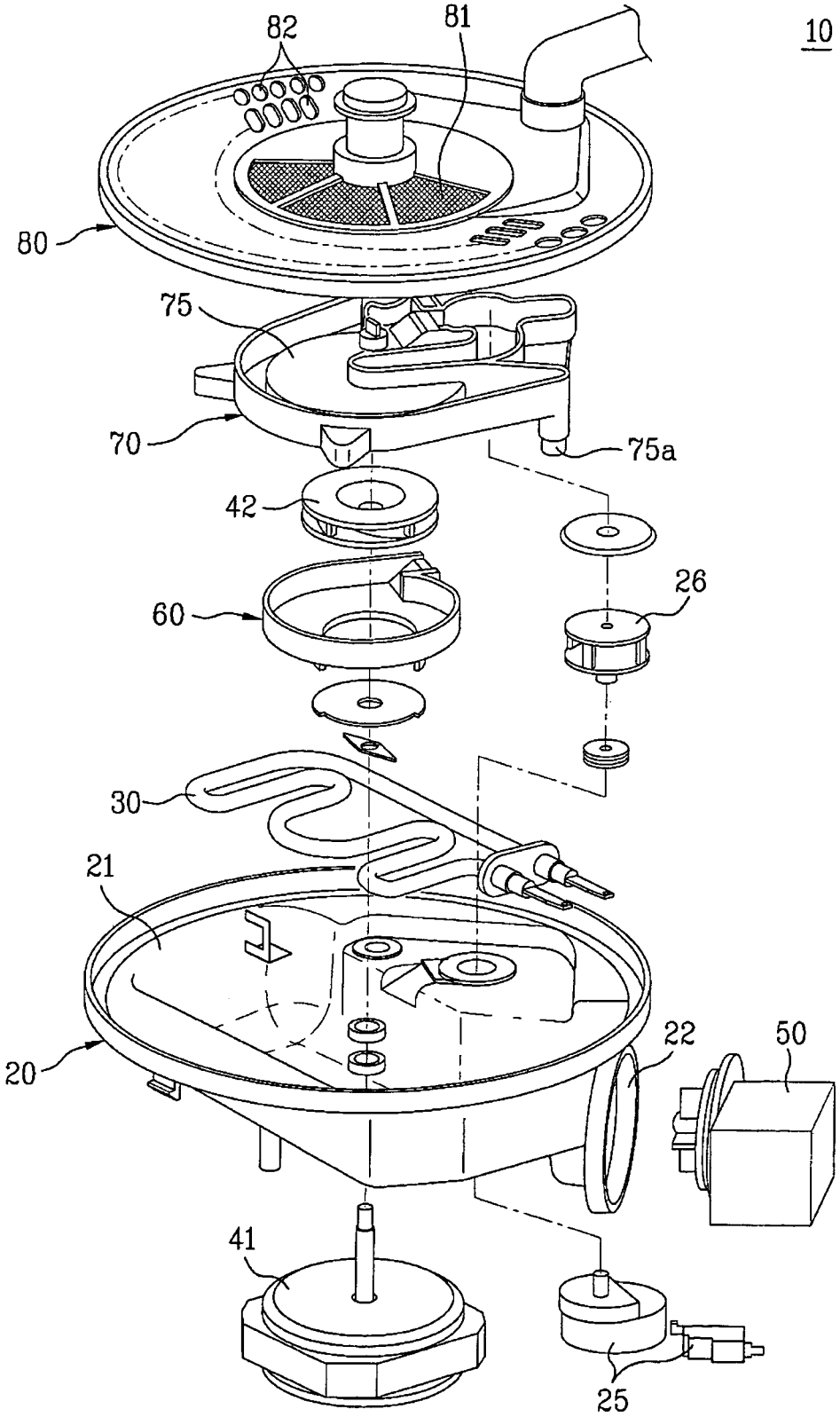
FIG. 2 is an exploded perspective view of a driving unit of a dishwasher according to an embodiment of the present invention.

FIG. 2 is an exploded perspective view of a driving unit of a dishwasher according to an embodiment of the present invention.

Referring to FIG. 2, the driving unit 10 includes a sump 20, a heater 30, a washing pump which include a washing motor 41 and an impeller 42, and a drain pump 50. The sump 20 collects the washing water and the heater 30 is disposed on the sump to heat the washing water. The washing pump is disposed below the sump 20 to pump the washing water. The drain pump 50 is disposed at a side of the sump 20 to drain the washing water. Also, a filtering unit is disposed on the sump 20 to receive the washing water that is sprayed on the dishes in the racks 6 and 7 and then falls down.

The sump 20 receives a tank 21 that collects the washing water. A drain chamber 22 is provided on one side of the tank 21. The drain chamber 22 is separated from the tank 21 and connected to the drain pump 50. Also, a passage control unit 25 is disposed below the tank 21. An upper portion of the passage control unit 25 is connected to a passage control valve 26.

The washing pump includes a washing motor 41 and an impeller 42. The washing motor 41 is disposed below the sump 20 to generate a driving force. The impeller 42 is connected to the washing motor 41 and pumps the washing water.

The filtering unit includes a pump housing 60, a filtering housing 70, and a cover 80. The impeller 42 is disposed within the pump housing 60 and the filtering housing 70 is disposed on the pump housing 60. Also, the cover 80 covers the upper surface of the sump 20 and encloses the filter housing 70 in between.

A contaminated water chamber 75 is disposed inside the filtering housing 60 and is connected to a drain hose 75*a* that communicates with the drain chamber 22. The drain hose 75*a* extends downward from the contaminated water chamber 75 by a predetermined length so that it is inserted into the drain chamber 22. A valve is provided at the drain hose 75*a* to selectively block the draining of the washing water.

The cover 80 includes a filter 81 disposed at a position corresponding to the upper surface of the contaminated water chamber 75. A plurality of return holes 82 are formed at an outer side of the filter 81 and communicate with an inside of the sump 20.

Figure 3:
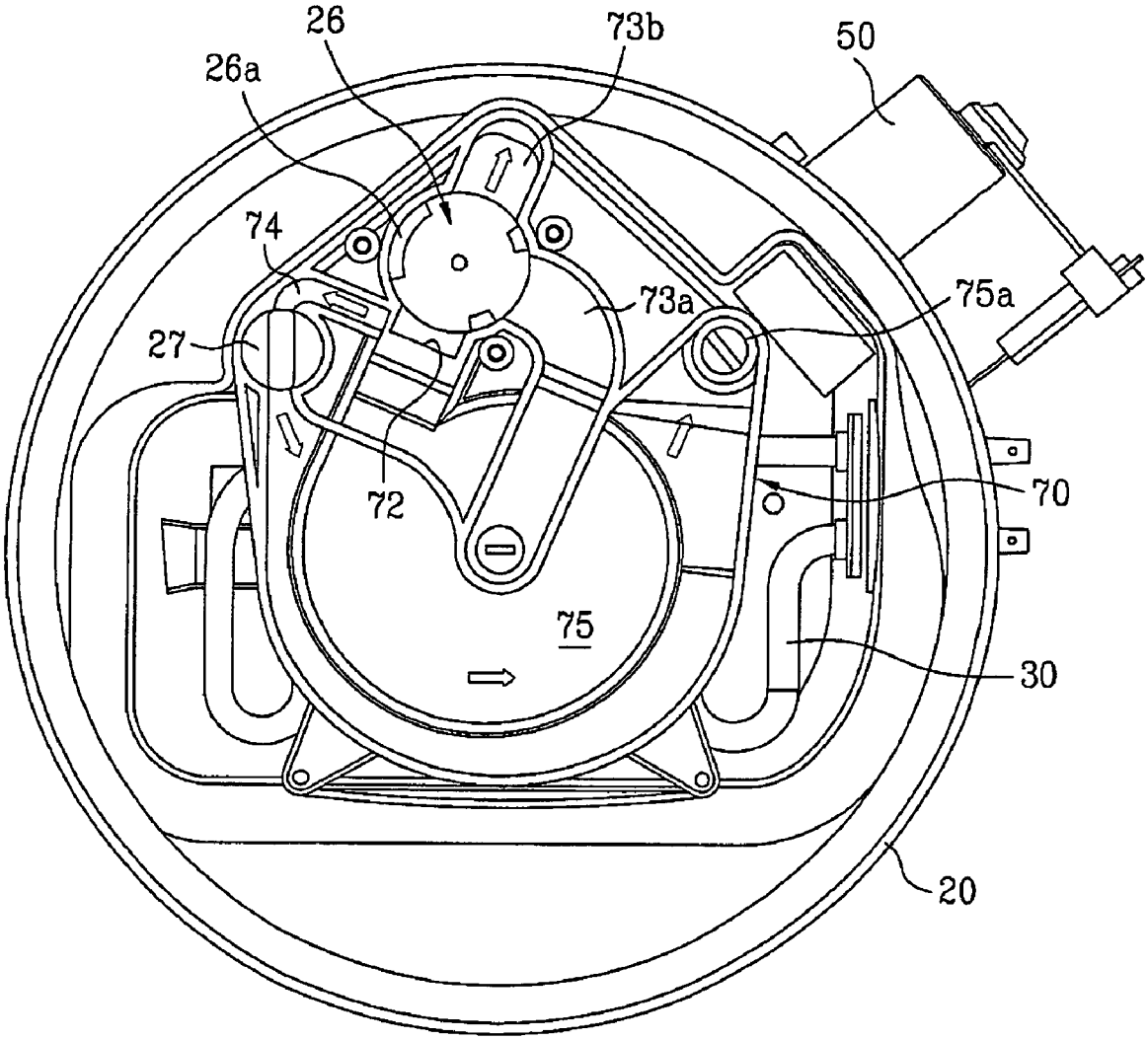
FIG. 3 is a plan view of a driving unit of a dishwasher according to an embodiment of the present invention.

FIG. 3 is a plan view of the driving unit when the cover is removed.

Referring to FIG. 3, an inlet 72, main passages 73*a* and 73*b*, a sampling passage 74, and a contaminated water chamber 75 are formed in the filtering housing 70. The washing water pumped by the impeller 42 flows into the inlet 72, and the inlet 72 is connected to the main passages 73*a* and 73*b* and the sampling passage 74. Moreover, the sampling passage 74 is connected to the contaminated water chamber 75.

The passage control valve 26 is rotatably installed in the inlet 72 to open/close the main passages. The passage control valve 26 is connected to the passage control unit 25 installed in the sump 20. A rib 26*a* is disposed at an outer periphery of the passage control valve 26. As the passage control valve 26 rotates, the rib 26*a* selectively closes one of the main passages 73*a* and 73*b*. Also, a contamination sensor 27 is disposed at the sampling passage 74 to detect the contamination level of the washing level. The contamination sensor 27 detects the contamination level of the washing water depending on how much light a light receiving part detects from a light-emitting element.

An operation of the dishwater according to the embodiment of the present invention will be described below.

The dishwasher carries out a preliminary washing cycle, a main washing cycle, a rinsing cycle, a heat rising cycle, and a drying cycle sequentially or selectively. A discharging cycle for discharging the washing water is carried out between the respective cycles. When the main washing cycle starts, the impeller 42 rotates with the rotation of washing motor.

Figure 4:
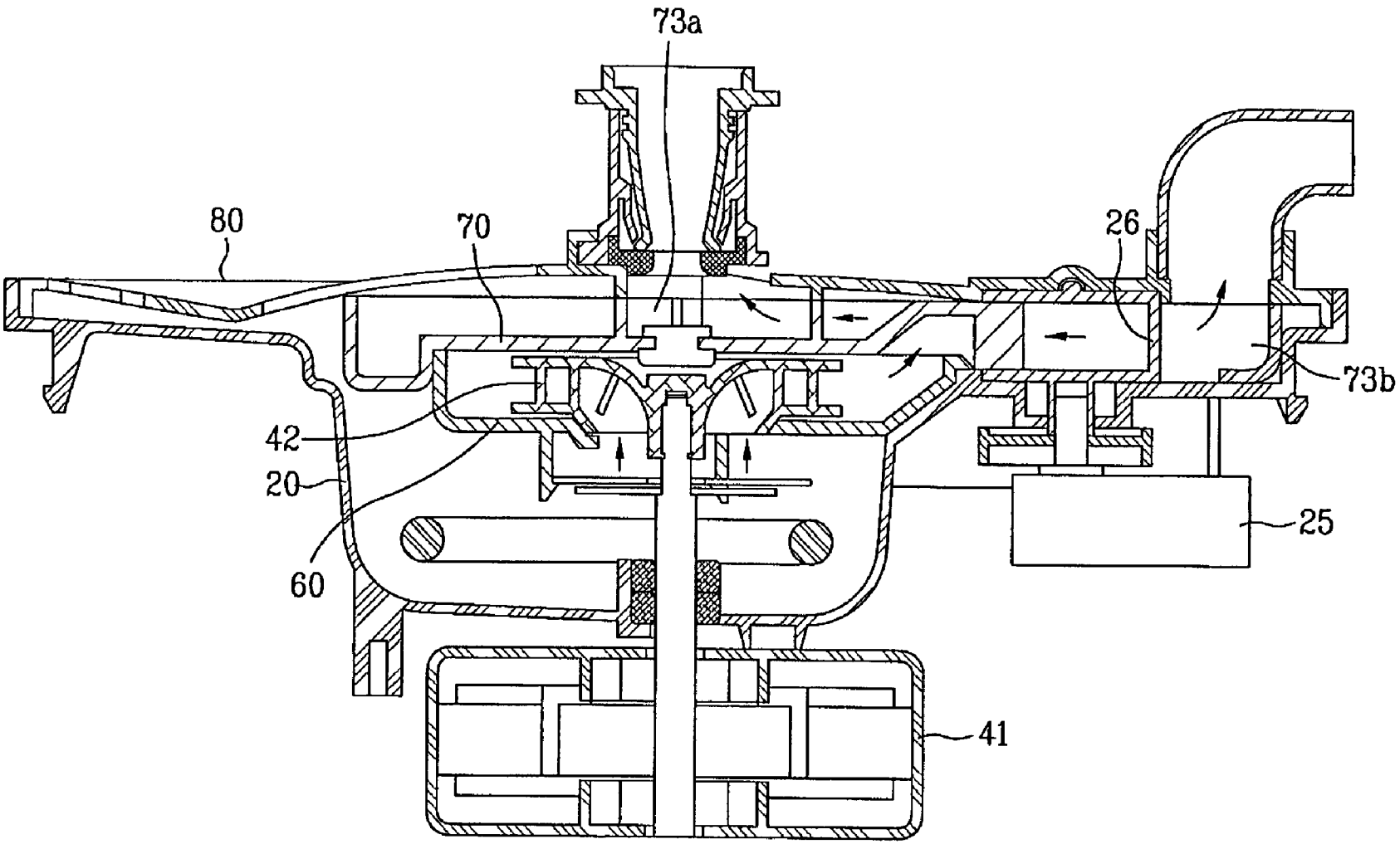
FIG. 4 is a sectional view illustrating flow passage of washing water within the driving unit of FIG. 2.

FIG. 4 is a sectional view illustrating flow passage of the washing water in the driving unit.

Referring to FIG. 4, the impeller 42 pumps the washing water collected in the sump 20 toward the inlet 72. As the passage control unit 25 rotates, the passage control valve 26 selectively opens either or both of the main passages 73*a* and 73*b*. The main passages 73*a* and 73*b* are connected to the upper and lower spray arms 4 and 6.

Some of the washing water introduced through the inlet 72 passes through the main passages 73*a* and 73*b* and flows into the upper spray arm 4 and/or the lower spray arm 5. The remaining washing water passes through the sampling passage 74 and flows into the contaminated water chamber 75.

The case where some of the washing water flows into the spray arm through the main passages 73*a* and 73*b* will now be described.

Figure 5A:
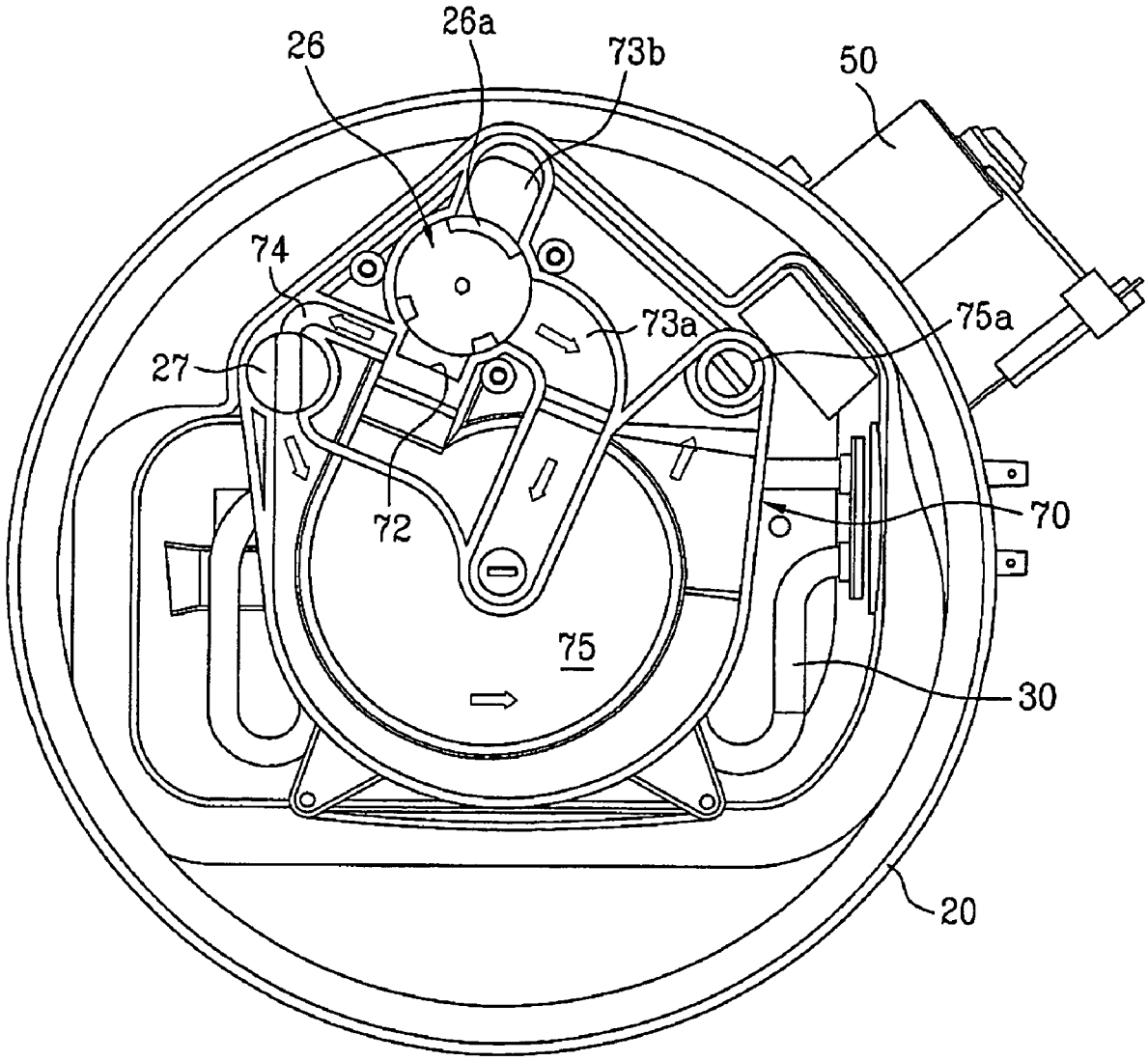
FIGS. 5A and 5B are plan views illustrating flow passages of washing water when some of the washing water is supplied to a lower spray arm or an upper spray arm in the driving unit of FIG. 2.
Figure 5B:
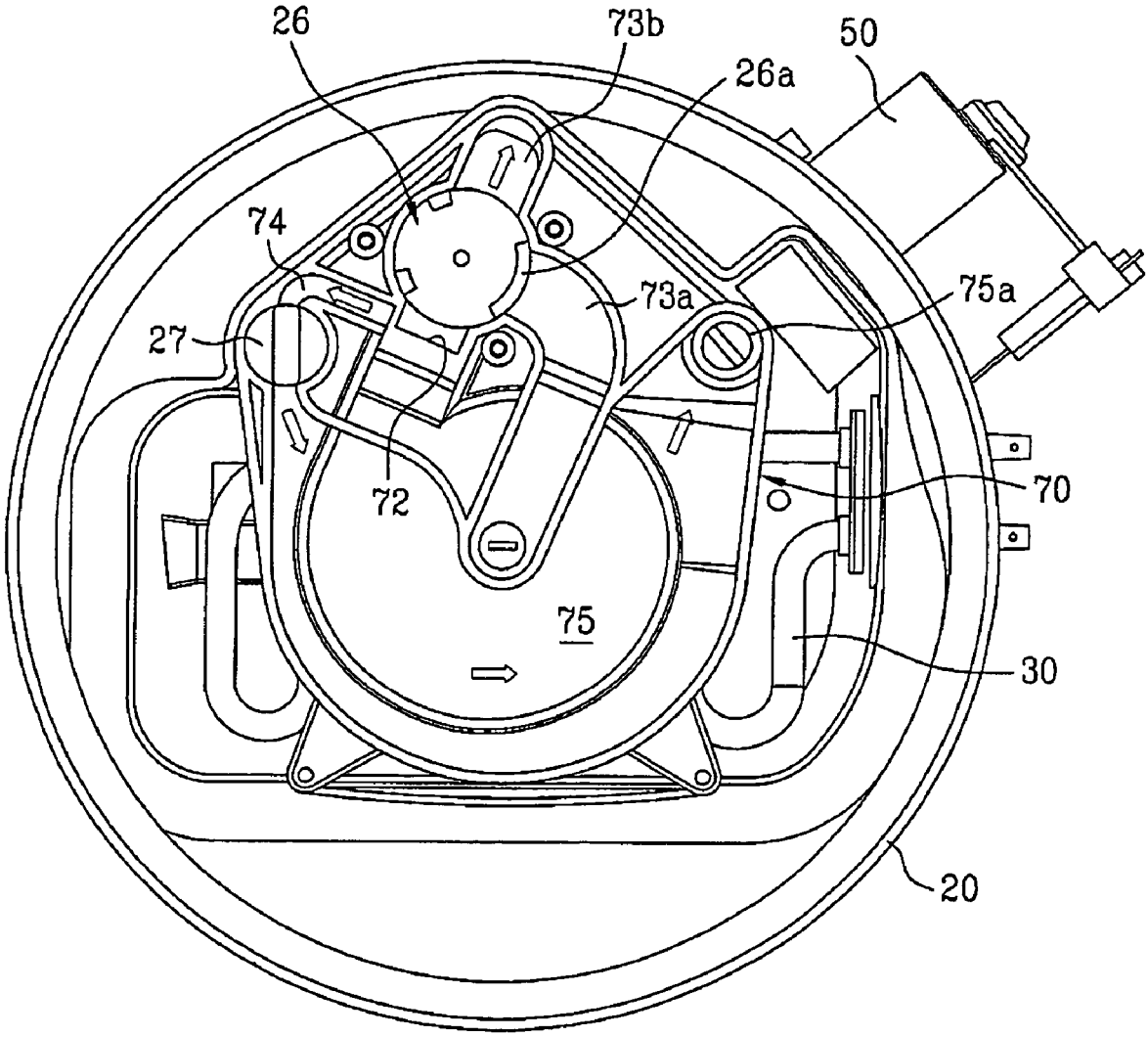

FIG. 5A is a plan view illustrating flow passage of the washing water when some of the washing water is supplied to the lower spray arm, and FIG. 5B is a plan view illustrating flow passage of the washing water when some of the washing water is supplied to the upper spray arm.

Referring to FIG. 5A, the passage control valve 26 rotates such that the rib 26*a* closes the second main passage 73*b* connected to the upper spray arm 4. Thus, the washing water flowing into the inlet 72 is supplied to the lower spray arm 5 through the first main passage 73*a*.

Referring to FIG. 5B, the passage control valve rotates such that the rib 26*a* closes the first main passage 73*a* connected to the lower spray arm 5. Thus, the washing water flowing into the inlet 72 is supplied to the upper spray arm 4 through the second main passage 73*b*.

When all dishes placed in the upper and lower racks 6 and 7 are completely washed, the passage control valve 26 rotates such that the main passages 73*a* and 73*b* are opened to supply the washing water to both of the upper and lower spray arms 4 and 5. As the passage control valve 26 alternately rotates forward and backward, the washing water flowing into the inlet 72 can be alternately sprayed through the upper and lower spray arms 4 and 5.

The washing water is sprayed through the upper and lower spray arms 4 and 5 to the upper and lower racks 6 and 7, resulting in washing the dishes. Thereafter, the washing water falls down on the upper surface of the cover 80 and is collected into the sump 20 through the return holes 82 formed in the cover 80.

Meanwhile, some of the washing water flowing into the inlet 72 is supplied to the first main passage 73*a* or the second main passage 73*b*. The remaining washing water flows into the contaminated water chamber 75 through the sampling passage 74. The washing water always flows into the sampling passage 74, without regard to the opening of the main passages 73*a* and 73*b* by means of the passage control valve 26.

The washing water flowing into the sampling passage 74 passes through the contamination sensor 27 and is introduced into the contaminated water chamber 75. Here, the washing water overflows through the filter 81 disposed above the contaminated water chamber 75 and the contaminants contained in the washing water are filtered by the filter 81.

The filtered washing water again flows into the sump 20 through the return holes 82 of the cover 80. Moreover, the waste products filtered by the filter 81 is separated from the filter 81 by the washing water sprayed through the lower spray arm 5. In such a structure, almost all washing water is filtered during the washing cycle. Thus, the consumption of the washing water can be reduced.

However, when relatively large contaminants are introduced into the contaminated water chamber 75, the filter may be blocked. In such cases, since water pressure within the contaminated water chamber 75 increases, the valve provided at the drain hose 75*a* is opened. At the same time, the filter can be deformed due to high water pressure.

Consequently, the washing water is drained, resulting in the waste of the washing water. Moreover, the washing water must be replenished in the amount equal to the amount of drained washing water. At this point, the replenished washing water is heated by the heater, resulting in the increase in the power consumption.

Figure 6:
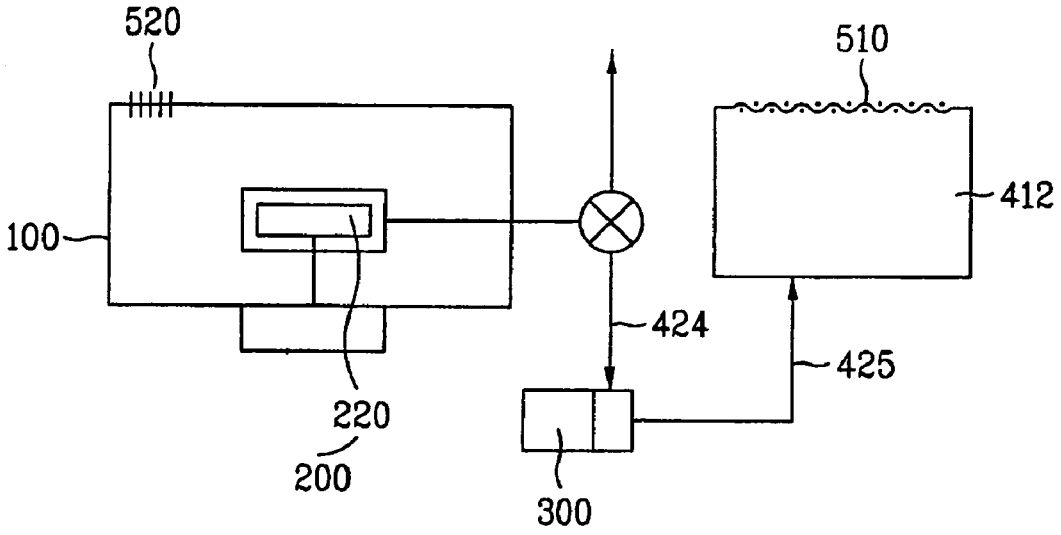
FIGS. 6 and 7 are schematic views of a driving unit of a dishwasher according to another embodiment of the present invention.
Figure 7:
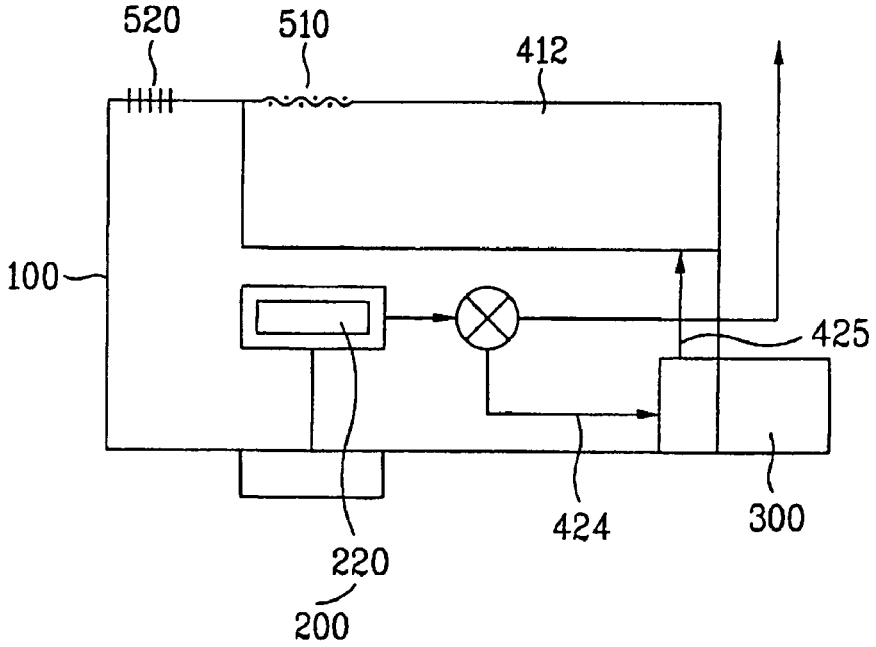

FIGS. 6 and 7 are schematic views of a driving unit of a dishwasher according to another embodiment of the present invention.

Referring to FIGS. 6 and 7, the dishwasher includes flow passages 424 and 425 in which some of the washing water pumped from the sump 100 by a washing pump 200 flows into a contaminated water chamber 412 through a drain pump 300. The flow passages 424 and 425 are provided to make the washing water pass through the drain pump 300.

Accordingly, the passages 424 and 425 can be applied to the case where the sump 100 and the contaminated water chamber 412 are separately disposed (refer to FIG. 6) or the case where the contaminated water chamber 412 is disposed within the sump 100 (refer to FIG. 7).

Also, the drain pump 300 can be fixed to either one of the sump 100 or the contaminated water chamber 412 or can be disposed independently.

The impeller 220 of the washing pump 200 is provided within the sump 100 so as to pump the washing water collected in the sump 100. Return holes 520 are formed at an upper surface of the sump 100 so that washing water sprayed from the spray arm can be recollected. A filtering unit 510 is provided at an upper portion of the contaminated water chamber 412 to filter the washing water while overflowing.

Preferably, the contaminated water chamber 412 should be separated within the sump 100 so as to reduce a volume of the dishwasher and simplify the structure. Hereinafter, the case where the contaminated water chamber is provided within the sump will be described as one example.

Figure 8:
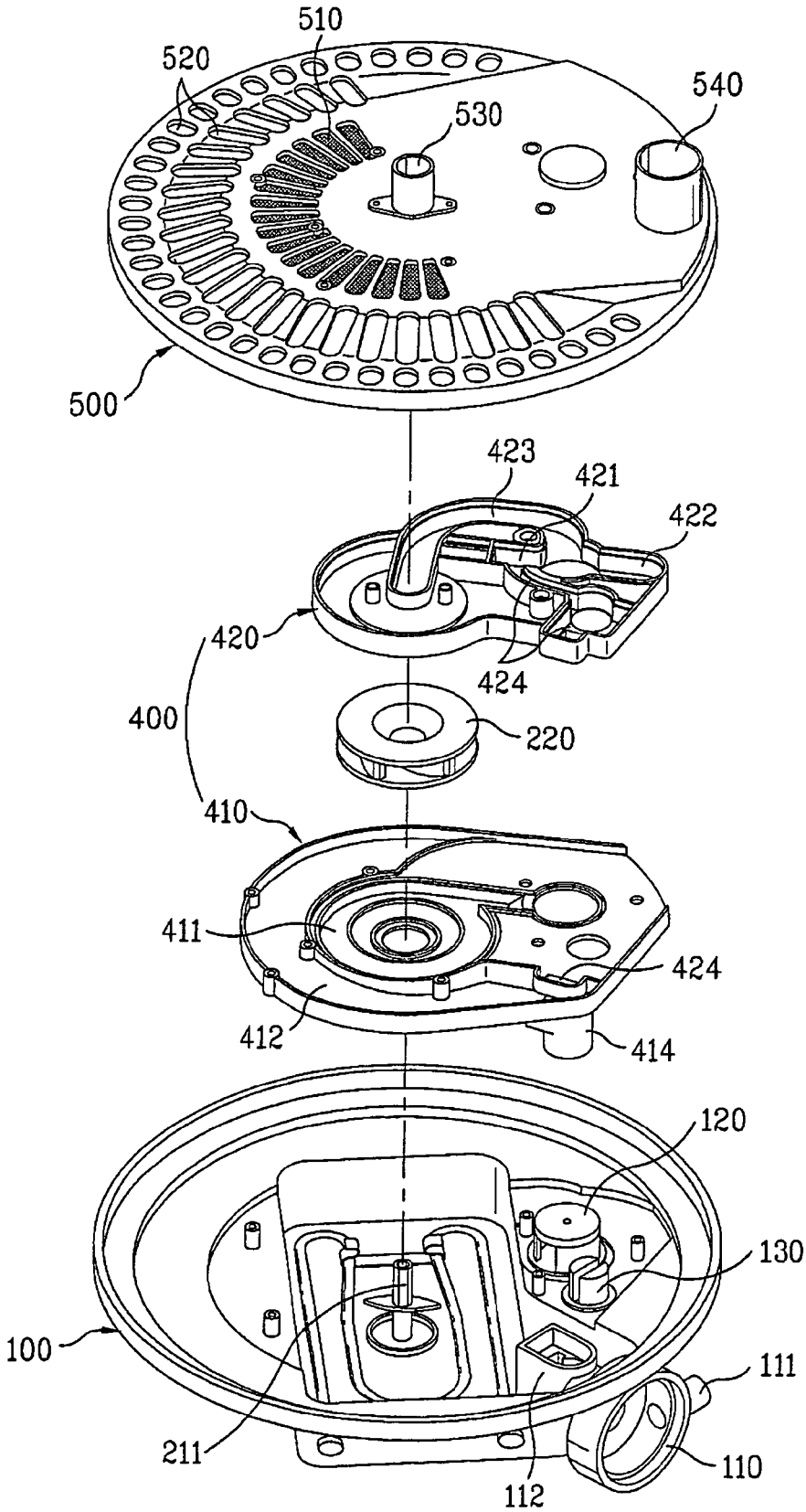
FIG. 8 is an exploded perspective view of a driving unit of a dishwasher according to another embodiment of the present invention.

FIG. 8 is an exploded perspective view of a driving unit of a dishwasher according to another embodiment of the present invention.

Referring to FIG. 8, the driving unit includes a sump 100, a washing pump 200, a drain pump 300, and a filtering unit.

The sump 100 collects washing water, and one side of the sump 100 is connected to the washing pump 200 (refer to FIG. 7) that pumps the washing water. Some of the washing water pumped by the washing pump 200 flows into a drain chamber 110 connected to one side of the drain pump 300 (refer to FIG. 7). Moreover, the filtering unit includes a contaminated water chamber 412 into which the washing water passing through the drain pump is introduced.

A washing water collecting part 120 and the drain chamber 110 are separately disposed within the sump 100. It is preferable that the drain chamber 110 should be provided at an entrance side of the drain pump 300. A drain hose 111 is provided at one side of the drain chamber 110. The washing water is drained out through the drain hose 111. It is preferable that the drain hose 111 should be closed except during the draining cycle.

A structure of the drain chamber 110 is described below in detail.

The filtering unit includes a filtering housing 400 and a cover 500. The filtering unit filters the washing water and recollects it into the sump. Also, the filtering unit guides the washing water pumped by the washing pump toward the spray arms.

For this purpose, the filtering housing 400 includes a lower housing 410 and an upper housing 420. The lower housing 410 includes an impeller loading unit 411, the contaminated water chamber 412, and a connecting passage (not shown). The contaminated water chamber 412 is provided along the periphery of the impeller loading unit 411. A position of the impeller loading unit 411 can be changed corresponding to that of a shaft 211 of a washing motor.

The upper housing 420 includes a sampling passage 424. Preferably, the sampling passage 424 should connect the impeller loading unit 411 and the drain chamber 110. The upper housing 420 includes a washing water inlet 421 corresponding to an outlet of the impeller loading unit 411. The washing water inlet 421 is connected to the main passages 422 and 423 and the sampling passage 424.

The lower housing 410 includes a connecting pipe 414 which corresponds to a connecting part 112 of the drain chamber 110. The connecting pipe 414 and the connecting part 112 are coupled together. Due to the flow passage formed by this connecting structure, the washing water of the sampling passage 424 flows into the contaminated water chamber 412 through the drain chamber 110.

The cover 500 covers the upper portion of the filter housing 400. The filtering unit 510 provided at the central portion of the cover such that the location of the filtering unit 510 corresponds to the contaminated water chamber 412.

Also, return holes 520 communicating with the sump 100 are formed at the periphery of the filtering unit 510. Adaptors 530 and 540 are provided at the cover 500 and are respectively connected to the upper spray arm and the lower spray arm.

The present invention is not limited to the above structure. The contaminated water chamber 412, the sampling passage 424 and the connecting passage (not shown) may be formed at one of the upper housing 410 and the lower housing 420. In addition, the lower housing 410 and the upper housing 420 may be formed in one body, and the cover 500 and the upper housing 420 may be formed in one body.

Figure 9:
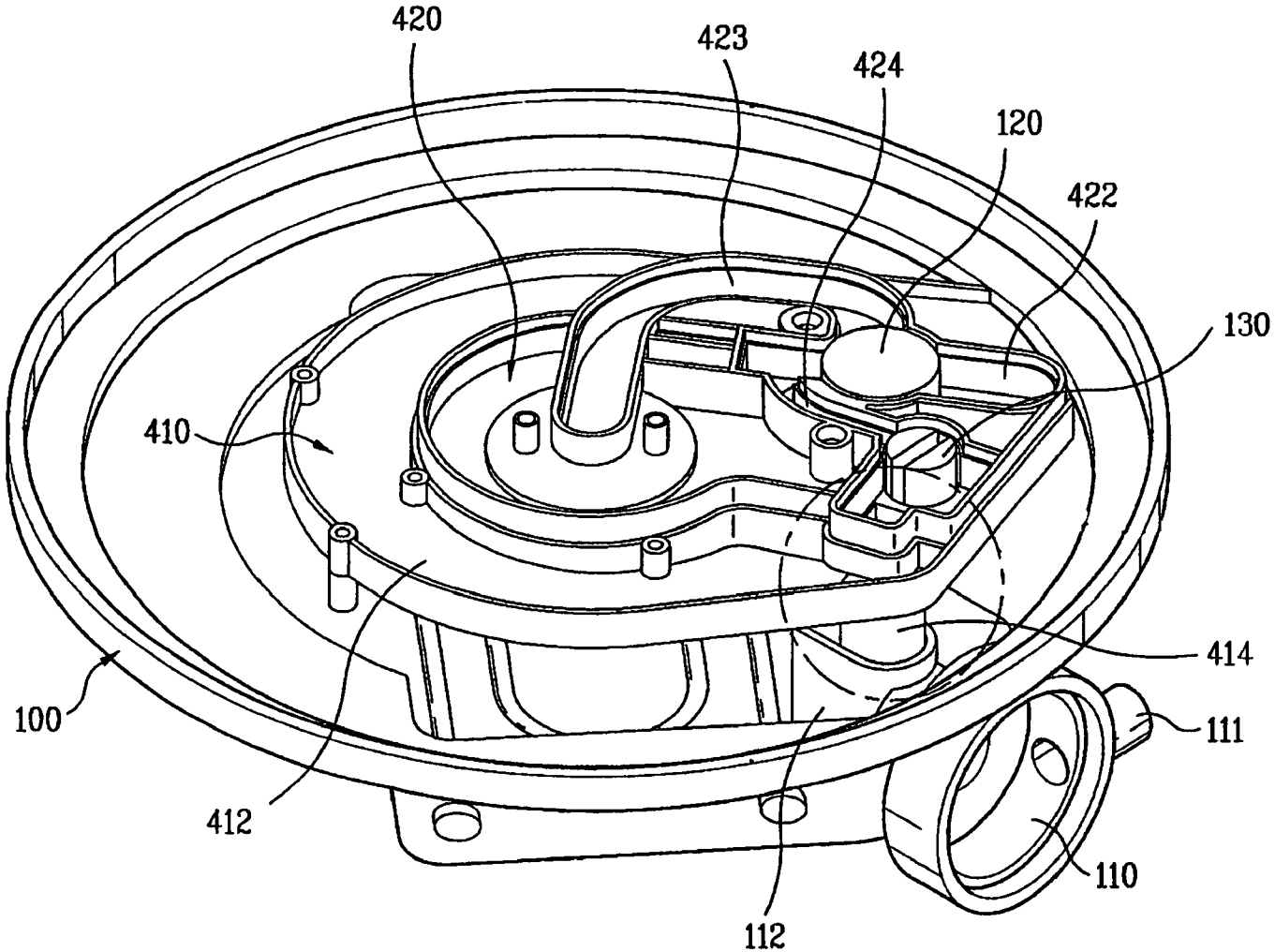
FIG. 9 is a plan view of a dishwasher according to another embodiment of the present invention.

FIG. 9 is a perspective view of a driving unit of a dishwasher according to another embodiment of the present invention.

Referring to FIG. 9, the upper housing 420 and the lower housing 410 are connected to an upper surface of the sump 100. The connecting pipe 414 of the lower housing 410 is inserted into the connecting part 112 connected to the drain chamber 110. A passage control valve 120 is provided at the washing water inlet (421 in FIG. 8) formed at the upper housing 420, and the contamination sensor 130 is installed in the sampling passage 424.

A position (e.g., an impeller loading unit) where the washing water is pumped is connected to the drain chamber 110 through the sampling passage 424.

Figure 10:
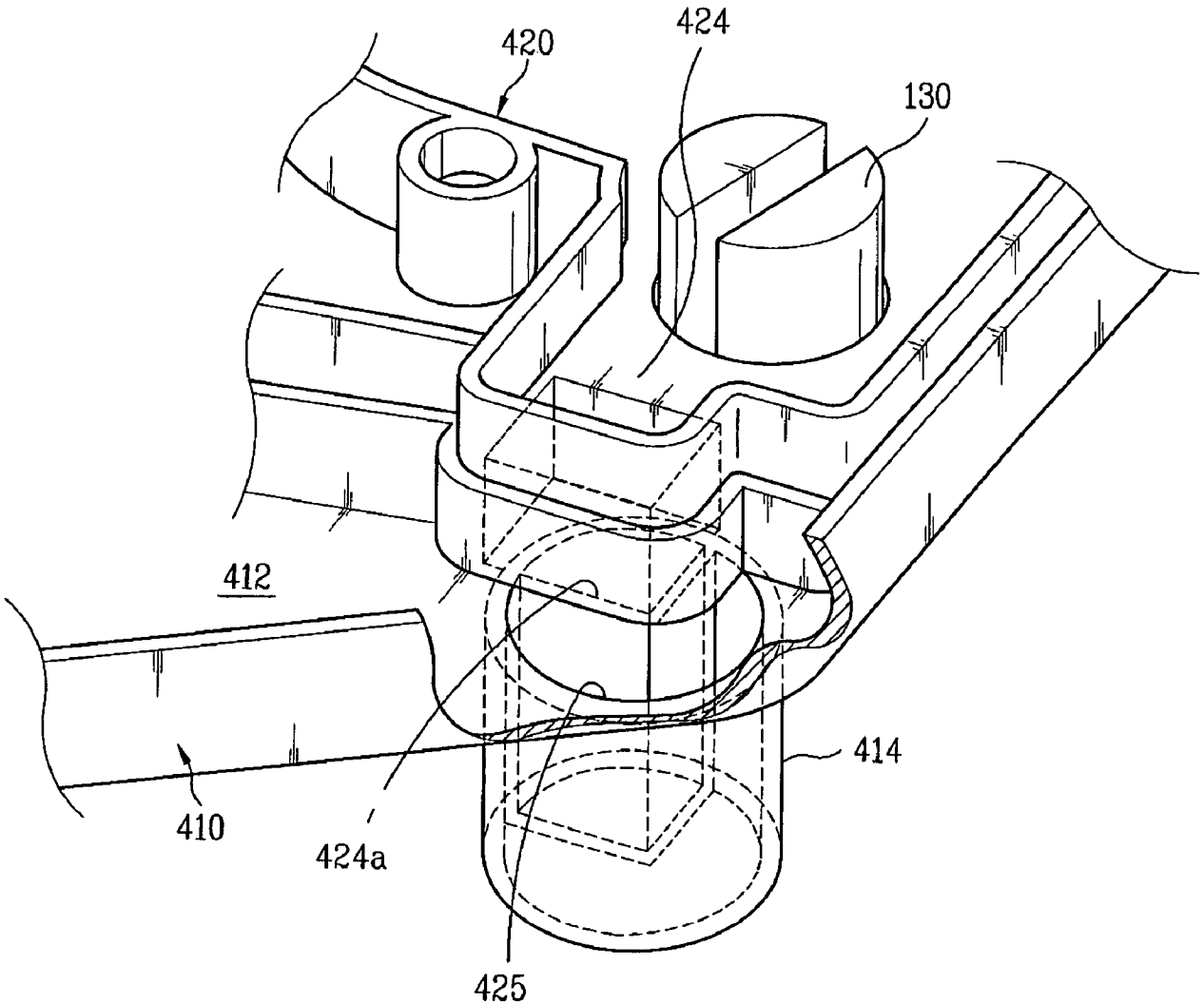
FIG. 10 is a magnified perspective view illustrating flow passage of a dishwasher according to another embodiment of the present invention.

FIG. 10 is a perspective view illustrating a structure of a sampling passage and a connecting passage according to another embodiment of the present invention.

Referring to FIG. 10, the drain chamber (110 in FIG. 8) is connected to the contaminated water chamber 412 through the connecting passage 425. For example, a lower portion 424*a* of the sampling passage 424 is inserted to an inside of the connecting pipe 414, and a connecting passage 425 is formed by space remaining or not occupied by the lower portion 424*a* in the connecting pipe 414 after the lower portion 424*a* is situated in the connecting pipe 414. That is, the inside of the connecting pipe 414 is divided by the connecting passage 425, which is formed between a space where one end 424*a* of the sampling passage is inserted and a space defined between one end 424*a* and an inner periphery of the connecting pipe 414.

With reference to the drain chamber 110, the sampling passage 424 is an inlet passage of the washing water and the connecting passage 425 is an outlet passage of the washing water. Accordingly, the sampling passage 424 and the connecting passage 425 function as the passages that actually pass through the drain chamber. However, the present invention is not limited to this structure. The sampling passage 424 may be separated from the connecting pipe and connected to the drain chamber.

Figure 11:
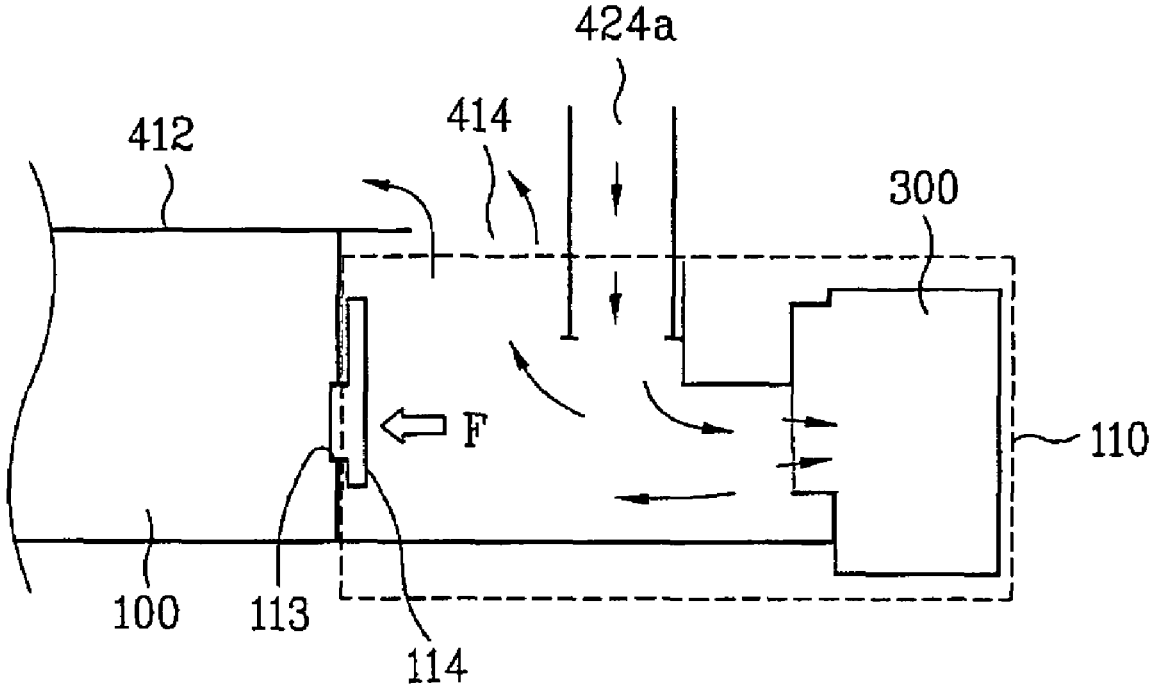
FIG. 11 is a schematic view of a drain chamber according to another embodiment of the present invention.

FIG. 11 is a schematic view of a drain chamber according to another embodiment of the present invention.

Referring to FIG. 11, the drain chamber 110 has a drain hole 113 that communicates with the sump 100, and a check valve 114 is provided at the drain hole 113. During the washing cycle, the check valve 114 is closed by water pressure (F) of the washing water, as indicated by an arrow. Meanwhile, during the draining cycle, the check valve 114 is opened by a suction force of the drain pump.

Figure 12A:
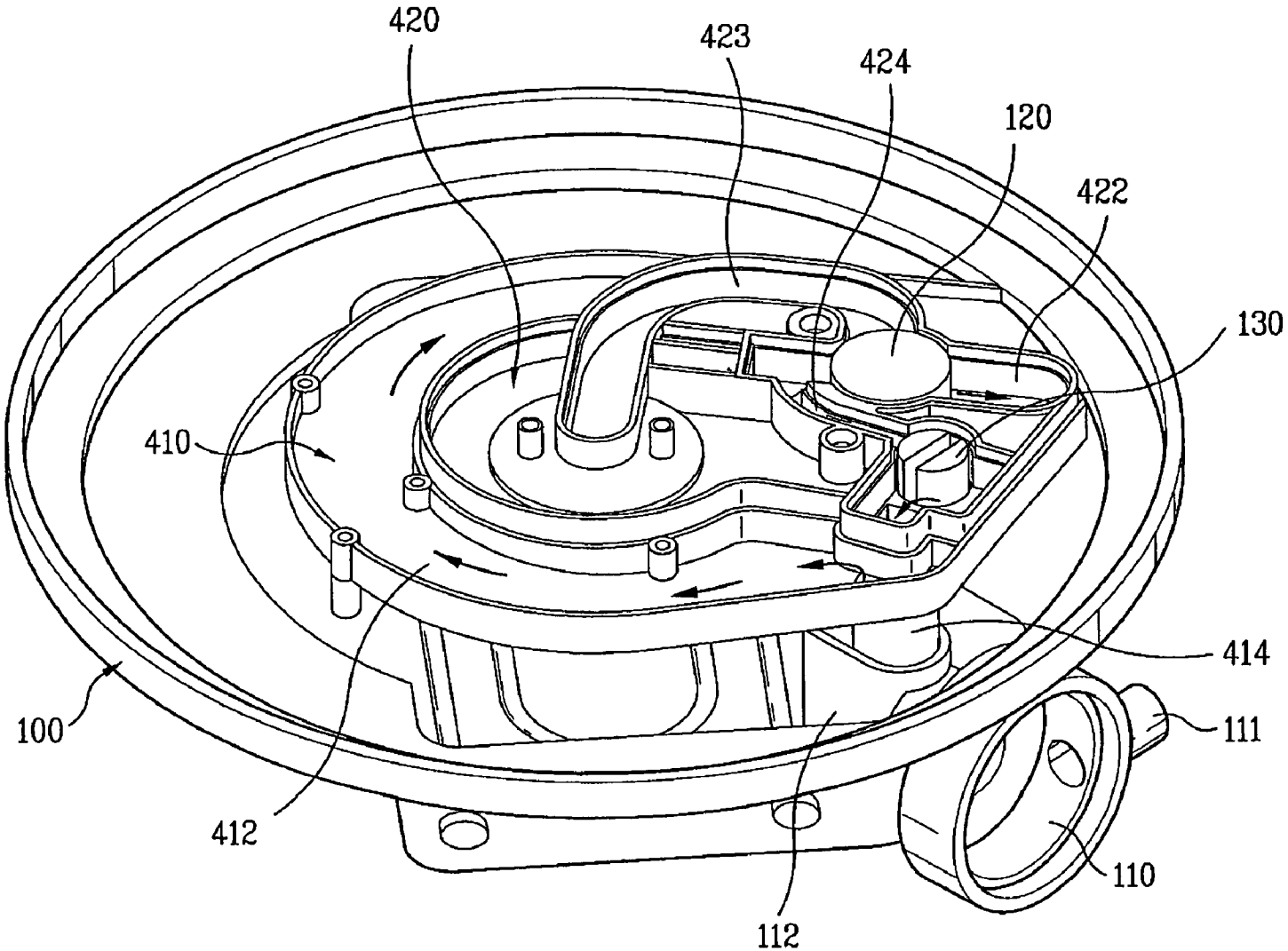
FIGS. 12A and 12B are perspective views illustrating flow passage of washing water during a washing cycle or a draining cycle in a driving unit of a dishwasher according to another embodiment of the present invention.

An operation of the dishwasher during the main washing cycle will be described below with reference to FIG. 12A.

When the main washing cycle starts, the impeller 220 rotates with the rotation of the washing pump 200. The impeller 220 introduces the washing water into the impeller loading unit 411 and pumps the washing water to the washing water inlet (421 in FIG. 8) formed at the upper housing 420.

As the passage control valve 120 rotates, some of the pumped washing water is simultaneously or alternately guided to the upper spray arm and/or the lower spray arm through the main passages 422 and 423. FIG. 12A illustrates the case where the washing water flows into the upper spray arm.

Meanwhile, the remaining pumped washing water flows into the sampling passage 424. At this point, the washing water is always introduced into the sampling passage 424, without regard to which main passage is opened by the passage control valve 120.

The washing water flowing into the sampling passage 424 is introduced into the drain chamber 110 through the connecting pipe 414. At this point, the drain hose 111 connected to one side of the drain chamber 110 is closed. The contaminants contained in the washing water settle in the drain chamber 110. Thus, the contaminants are initially filtered in the drain chamber 110. That is, the drain chamber 110 functions as a disposal tank during the washing cycle.

Thereafter, the washing water of the drain chamber 110 flows into the contaminated water chamber 412 through the connecting passage (425 in FIG. 10). A size and amount of the waste products flowing into the contaminated water chamber 412 are reduced. Accordingly, it is possible to prevent the filtering unit of the cover from being blocked due to the waste products. Also, the water pressure applied to the contaminated water chamber 412 is relatively lowered.

Meanwhile, the washing water flowing into the contaminated water chamber 412 overflows through the filter. The filter of the cover (500 in FIG. 8) secondarily filters small waste products contained in the washing water. The filtered washing water again flows into the sump 100 through the drain hole 113 of the cover 500.

At this point, the check valve (114 in FIG. 11) closes the drain hole 113 by the water pressure acting on the drain chamber 110. Accordingly, it is possible to prevent the washing water of the drain chamber 110 from being reversibly introduced into the sump 100 through the drain hole 113.

Hereinafter, a draining cycle will be described below. The draining cycle is performed after the main washing cycle to drain the washing water used during the washing cycle.

As shown in FIG. 11, the drain pump (300 in FIG. 11) starts operating at the start of the draining cycle. At this point, the check valve 114 opens the drain hole 113 by the suction force of the drain pump 300.

Figure 12B:
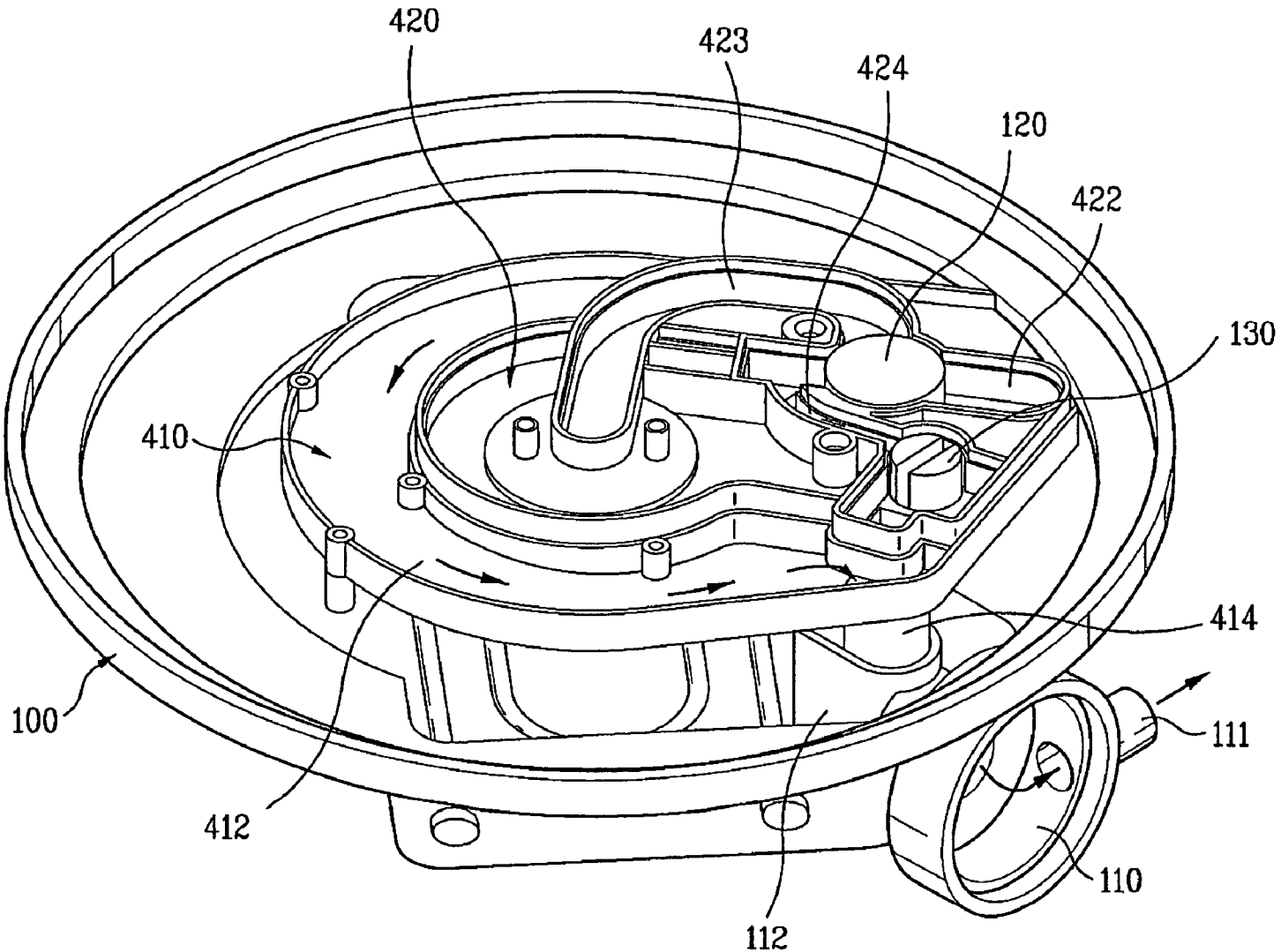

FIG. 12B is a perspective view illustrating an operation of the dishwasher during the draining cycle according to another embodiment of the present invention.

Referring to FIG. 12B, the washing water of the sump 100 and the waste products are introduced into the drain chamber 110. Consequently, the washing water and the waste products contained in the contaminated water chamber 412 are also introduced into the drain chamber 110. The washing water and the waste products introduced into the drain chamber 110 are drained out through the drain hose 111.

The dishwasher according to the present invention has the following advantages.

First, since the washing water supplied to the sampling passage flows into the contaminated water chamber through the drain chamber, large waste products contained in the washing water settles on the drain chamber. Accordingly, it is possible to prevent large waste products from flowing into the contaminated water chamber.

Second, blocking of the filter disposed at the cover can be delayed by preventing large waste products from flowing into the contaminated water chamber. Thus, it is possible to prevent water pressure from increasing in the contaminated water chamber due to the blocking of the filter. Also, it is possible to prevent the filter from being deformed.

Third, even when the filter is blocked, it can be buffered by the drain chamber of the sump. Therefore, it is possible to prevent water pressure from rapidly increasing in the contaminated water chamber.

Fourth, the check valve is closed during the washing cycle by water pressure of the washing pump and it is opened during the draining cycle by suction force of the drain pump. Accordingly, it is possible to prevent the washing water from being drained out during the washing cycle. Consequently, it is possible to reduce the washing water consumption and the power consumption.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A dishwasher comprising:

a sump for storing washing water;

a washing pump for pumping the washing water;

at least one main passage that guides some of the washing water pumped by the washing pump to a spray arm;

a sampling passage that guides the remaining washing water pumped by the washing pump to a drain chamber which is communicated with a drain pump, wherein the drain chamber receives the remaining washing water through the sampling passage and collects waste products contained in the remaining washing water which are settled in the drain chamber;

a contaminated water chamber disposed above the drain chamber for receiving the remaining washing water after the remaining washing water has passed through the drain chamber; and a filtering unit disposed above the drain chamber for filtering the remaining washing water that overflows from the contaminated water chamber.

2. The dishwasher of claim 1, wherein the drain chamber is provided at an entrance side of the drain pump.

3. The dishwasher of claim 2, wherein the drain pump is connected to one side of the sump.

4. The dishwasher of claim 1, wherein the filtering unit includes a cover which covers an upper portion of the contaminated water chamber, the cover including a filter for filtering the remaining washing water that overflows from the contaminated water chamber.

5. The dishwasher of claim 4, wherein the cover includes return holes formed at a periphery of the cover to communicate with the sump.

6. The dishwasher of claim 1, further comprising a contamination sensor disposed at the sampling passage to measure a level of contamination of the washing water.

7. The dishwasher of claim 1, further comprising a passage control unit for selecting to open or close at least one main passage, the passage control unit is located at an intersection of the main passages and the sampling passage.

8. The dishwasher of claim 1, wherein the filtering unit comprises:

a lower housing, disposed above the sump, including an impeller loading unit for mounting an impeller connected to the washing pump, the contaminated water chamber and a connecting pipe connecting the contaminated water chamber to the drain chamber;

an upper housing disposed above the lower housing; and a cover for entirely covering an upper portion of the sump, the cover including a filter that covers an upper portion of the contaminated water chamber, wherein the at least one main passage and the sampling passage are formed at the upper housing and one end of the sampling passage is inserted into the connecting pipe.

9. The dishwasher of claim 8, further comprising a connecting passage formed between an inner periphery of the connecting pipe and an outer periphery of one end of the sampling passage.

10. The dishwasher of claim 8, wherein the sampling passage is provided to connect an outlet of the impeller loading unit and the drain chamber.

11. The dishwasher of claim 1, wherein a drain hole is provided to the drain chamber for communicating with the sump, and a check valve is provided to the drain hole for opening the drain hole during a draining cycle.

* * * * *